US005950452A

United States Patent [19]

Sakitani et al.

[11] Patent Number: 5,950,452

[45] Date of Patent: Sep. 14, 1999

[54] ROTARY COMPRESSOR AND REFRIGERATING APPARATUS

[75] Inventors: Katsumi Sakitani; Masanori Masuda; Takahiro Uematsu; Takekazu Obitani, all of Osaka; Shigeharu Taira; Youichi Oonuma, both of Shiga, all of Japan

[73] Assignee: Daikin Industries, Ltd., Osaka, Japan

[21] Appl. No.: 08/901,669

[22] Filed: Jul. 28, 1997

Related U.S. Application Data

[63] Continuation of application No. 08/663,107, filed as application No. PCT/JP95/02206, Oct. 27, 1995, abandoned.

[30] Foreign Application Priority Data

Oct. 31, 1994 [JP] Japan ..... 6-267032

[51] Int. Cl.[6] ..... F25B 1/00; F01C 1/02

[52] U.S. Cl. ..... 62/498; 62/114; 418/66

[58] Field of Search ..... 62/114, 84, 498, 62/508; 418/66

[56] References Cited

U.S. PATENT DOCUMENTS

| | | | |
|---|---|---|---|
| 1,523,785 | 1/1925 | Martin . | |
| 2,342,174 | 2/1944 | Wolfert . | |
| 3,070,078 | 12/1962 | Dillenberg | 418/66 X |
| 5,372,737 | 12/1994 | Spauschus | 62/114 X |
| 5,383,774 | 1/1995 | Toyama et al. | 418/66 |
| 5,419,144 | 5/1995 | Kawaguchi et al. | 62/84 |
| 5,520,833 | 5/1996 | Kaneko | 62/84 X |

FOREIGN PATENT DOCUMENTS

| | | | |
|---|---|---|---|
| 0485979A2 | 5/1992 | European Pat. Off. . | |
| 0591539 | 4/1994 | European Pat. Off. . | |
| 0600131 | 6/1994 | European Pat. Off. . | |
| 725051 | 5/1932 | France . | |
| 61-114082 | 7/1986 | Japan . | |
| 2269004 | 1/1994 | United Kingdom | 62/114 |

*Primary Examiner*—William Wayner

[57] ABSTRACT

A blade 8 is integrally fixed to a roller 7 mounted around an eccentric section 22 of a drive shaft 21. The blade 8 extend radially outwardly of the roller 7, and partitions the inside of a cylinder chamber 41 into a compression chamber X and a suction chamber Y. A protruded end portion of the blade 8 is received in a reception groove 11*a* of a support member 11 which is pivotally supported by a stationary member 4. A substitute fleon refrigerant is used as a working fluid in the cylinder chamber 41, and an oil adapted to the substitute fleon refrigerant is used as a lubricating oil for a compressor CP. While using the substitute fleon refrigerant, the deterioration of the oil in the compressor is prevented.

9 Claims, 5 Drawing Sheets

ROTARY COMPRESSOR AND REFRIGERATING APPARATUS

This application is a continuation of application Ser. No. 08/663,107 filed on Jun. 28, 1996, now abandoned, which is a 371 of PCT/JP95/02206, filed Oct. 27, 1995.

TECHNICAL FIELD

The present invention relates to a rotary compressor and a refrigerating apparatus in which the rotary compressor is incorporated.

BACKGROUND ART

Conventionally, there has been a rotary compressor as shown in FIGS. 6 and 7 (refer to Japanese Utility Model Laid-Open Publication No. SHO 61-114082). This prior art compressor is provided with a compression element A that is driven by a motor inside its hermetic casing. This compression element A includes a cylinder C having a cylinder chamber B, and a roller E that is closely mounted around an eccentric section D of a drive shaft extending from an electric motor. This roller E revolves inside the cylinder chamber B by the rotation of the drive shaft. Furthermore, the compression element A has a blade H. This blade H is arranged between a suction port F and a discharge port G formed at the cylinder C so that it is allowed to advance and retreat there. Further, the blade H is operated by a part of a high-pressure gas discharged from the discharge port G used as a back pressure. A tip end portion of the blade H is always put in contact with a part of an outer peripheral surface of the roller E by the back pressure. With this arrangement, the blade H partitions the cylinder chamber B into a compression chamber X and a suction chamber Y. Further, a valve seat is formed around the exit of the discharge port G. To this valve seat is fixed an end portion of a valve I. This valve I can open and close the discharge port G.

In the compressor having the above structure, the roller E revolves inside the cylinder chamber B when the drive shaft D rotates. This revolving roller E compresses a gas in the compression chamber X partitioned by the blade H in the cylinder chamber B. Subsequently, when this compression process is completed to proceed to a discharge process, the roller E opens the valve I by the compressed high-pressure gas to discharge the high-pressure gas from the discharge port G into a casing.

When the discharge process is completed to proceed to a suction process, the valve I closes the discharge port G. Then, the roller E revolves to inhale a low-pressure gas from the suction port F into the suction chamber Y partitioned by the blade H in the cylinder chamber B. Thus, the roller E repeats the compression process and the discharge process while revolving in the cylinder chamber B.

However, in the above compressor, the blade H is supported by the cylinder C to be allowed to advance and retreat, where the blade H and the roller E are relatively moved with the tip end of the blade H put in contact with the outer peripheral surface of the roller E by the back pressure. Therefore, it is required to exert the back pressure on the blade H to press the tip end of the blade H against the outer peripheral surface of the roller so as to put them in contact with each other. Furthermore, since the portion of the blade H put in contact with the outer peripheral surface of the roller is lubricated little, they are put in a boundary lubrication state. In this boundary lubrication state, a metallic contact tends to occur, and this possibly causes seizure problematically.

Also, when an HCFC (hydrochlorofluorocarbon) group fleon refrigerant (e.g., R22) is used as a working fluid for use in a compressor, a chloride film is formed by the chlorine contained in the fleon refrigerant even when a deficient lubrication occurs, and the chloride film has suppressed the seizure to some degree.

However, when using an HFC (hydrofluorocarbon) group substitute fleon refrigerant (e.g., R134a), the lubricating oil (mainly a synthetic oil) used in adaptation with the substitute fleon refrigerant has a lubricating capability lower than that of the lubricating oil (mineral oil) that has been used with the conventional fleon refrigerant. Furthermore, the substitute fleon refrigerant is not containing chlorine, and therefore, no chloride film is formed. Therefore, in the portion of the boundary lubrication, a temperature rise partially occurs to cause such a problem that the oil deteriorates to incur a hydrolysis or generate a sludge.

Furthermore, in the refrigerating apparatus in which the prior art rotary compressor is incorporated into its refrigerating circuit, when a capillary tube is used as a pressure reduction mechanism of the refrigerating apparatus, a great amount of sludge generated due to the oil deterioration adheres to the inside of the tube. The adhesion of sludge incurs the reduction in flow rate of the refrigerant, and this problematically impairs the reliability of the refrigerating apparatus.

Accordingly, in view of the above-mentioned problems, it is an object of the present invention to provide a rotary compressor capable of preventing the oil in the compressor from deteriorating while using a substitute fleon refrigerant. Another object of the present invention is to improve the reliability of the refrigerating apparatus by providing a refrigerating apparatus having a rotary compressor free from the occurrence of oil deterioration.

DISCLOSURE OF THE INVENTION

According to a first aspect of the invention, there is provided a rotary compressor comprising:

a roller rotatably mounted around an eccentric section of a drive shaft;

a blade which is integrally fixed on a periphery of the roller and extends radially outwardly of the roller, thereby partitioning a cylinder chamber inside a cylinder into a compression chamber and a suction chamber; and a support member which is pivotally supported by the cylinder and is formed with a reception groove for receiving and guiding therein a protruded end portion of the blade, wherein a refrigerant which does not include chlorine within its basic chemical composition is used as a working fluid to be supplied to and discharged from the inside of said cylinder chamber, and an oil adapted to the refrigerant is used as a lubricating oil.

According to the first aspect of the invention, the blade is fixed on the roller, and the end portion of the blade is guided by the reception groove of the support member. Therefore, such a boundary lubrication state of the blade and the roller as in the prior art does not occur. Therefore, according to the first aspect of the invention, while enabling a substitute fleon refrigerant to be used in consideration of the environmental safety, the frictional loss and a power loss in the sliding portion inside the compressor can be reduced to allow the occurrence of seizure and oil deterioration of the lubricating oil to be prevented.

According to the second aspect of the invention, in the rotary compressor of the first aspect, a pipe-shaped metal inserted in between an inner peripheral surface of the roller and the eccentric section of the drive shaft is provided.

Therefore, according to the second aspect of the invention, the occurrence of seizure of the eccentric section with the roller can be prevented by the pipe-shaped metal even when the lubricating capability is reduced due to the use of a substitute fleon refrigerant.

According to the third aspect of the invention, in the rotary compressor claimed in the first aspect, the refrigerant is a single substance which belongs to a group of substances classified into hydrofluorocarbon (HFC).

According to the fourth aspect of the invention, in the rotary compressor of the first aspect, said refrigerant is a mixture refrigerant obtained by mixing a plurality of substances which belong to a group of substances classified into hydrofluorocarbon (HFC).

According to the fifth aspect of the invention, in the rotary compressor of the first aspect, said lubricating oil is any of a synthetic oil to which ester oil and ether oil belong, fluorine oil, alkylbenzene oil and mineral oil.

According to the sixth aspect of the invention, there is provided a refrigerating apparatus comprising:

a refrigerating circuit having a rotary compressor including a roller rotatably mounted around an eccentric section of a drive shaft, a blade which is integrally fixed on a periphery of the roller and extends radially outwardly of the roller, thereby partitioning a cylinder chamber inside a cylinder into a compression chamber and a suction chamber, and a support member which is pivotally supported by the cylinder and is formed with a reception groove for receiving and guiding therein a protruded end portion of the blade; and a capillary tube which serves as a pressure reduction mechanism, wherein a refrigerant which does not include chlorine within its basic chemical composition is used as a working fluid to be circulated through the refrigerating circuit, and an oil adapted to the refrigerant is used as a lubricating oil of the compressor.

Therefore, according to the refrigerating apparatus of the sixth aspect, it is provided with the rotary compressor in which the blade is fixed on the roller, and the end portion of the blade is guided by the reception groove of the support member. Therefore, such a boundary lubrication state of the blade and the roller as in the prior art does not occur. Furthermore, the frictional loss and the power loss in the sliding section inside the compressor can be reduced, and a substitute fleon refrigerant for assuring the environmental safety can be used without incurring the seizure nor the oil deterioration of the lubricating oil. Furthermore, the adhesion of oil sludge to the inside of the capillary tube can be prevented, and therefore, the reduction in flow rate of the refrigerant can be prevented, thereby allowing the reliability of the refrigerating apparatus to be improved.

According to the seventh aspect of the invention, in the refrigerating apparatus of the sixth aspect, said refrigerant is a single substance which belongs to a group of substances classified into hydrofluorocarbon (HFC).

According to the eighth aspect of the invention, in the refrigerating apparatus of the sixth aspect, said refrigerant is a mixture refrigerant obtained by mixing a plurality of substances which belong to a group of substances classified into hydrofluorocarbon (HFC).

According to the ninth aspect of the invention, in the refrigerating apparatus of the sixth aspect, said lubricating oil is any of a synthetic oil to which ester oil and ether oil belong, fluorine oil, alkylbenzene oil and mineral oil.

BEST MODE FOR CARRYING OUT THE INVENTION

Embodiments of the present invention will now be described with reference to the accompanying drawings in order to describe the present invention more in detail.

(First Embodiment)

Figure 2:
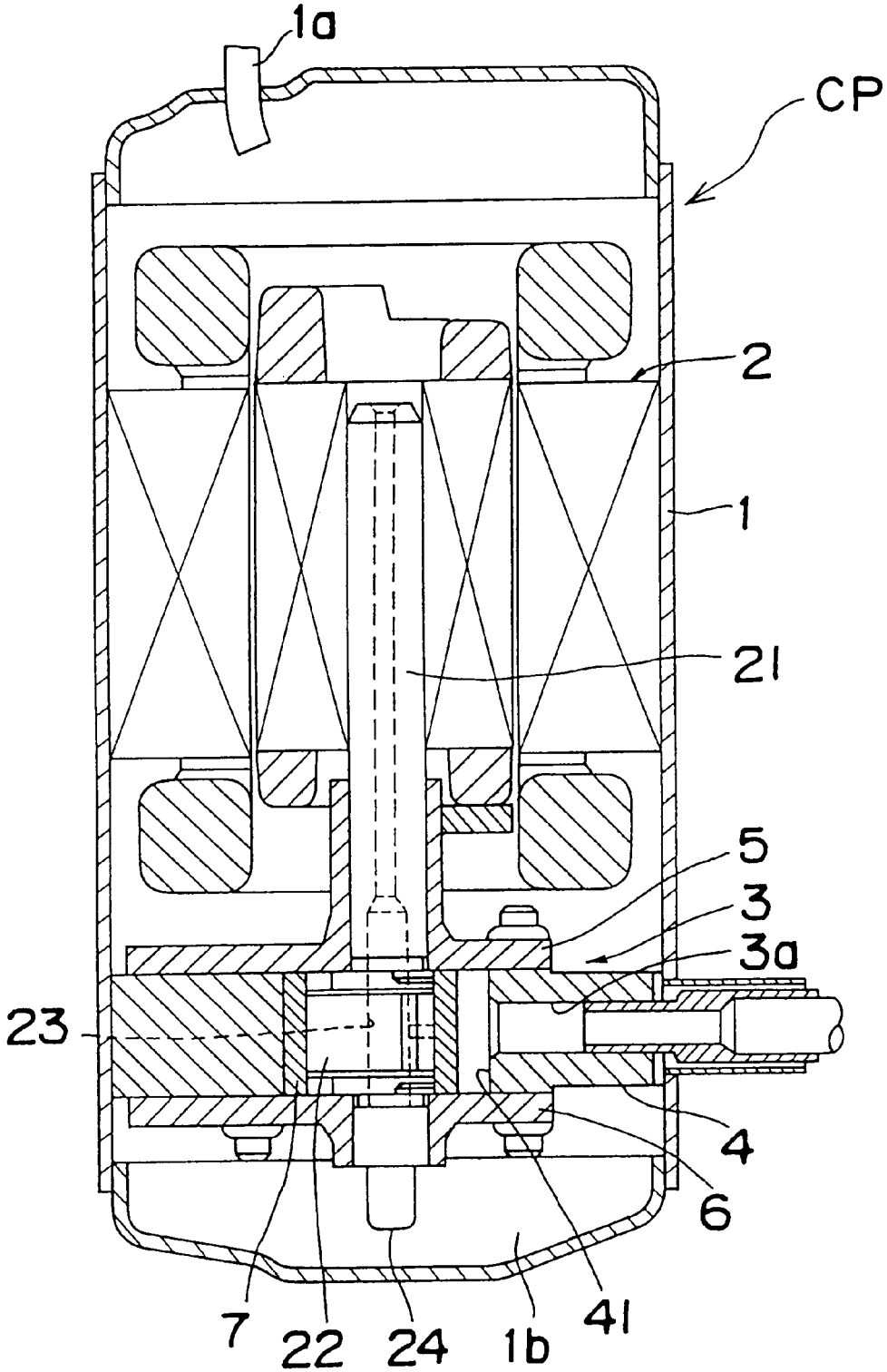
FIG. 2 is a longitudinal section view showing all the structure of the above rotary compressor.

FIG. 2 shows a rotary compressor CP of the embodiment of the present invention. This rotary compressor CP has a motor 2 upwardly inside its hermetic casing 1. Further, a compression element 3 is provided below the motor 2. Then, a drive shaft 21 extending from the motor 2 is interlockedly connected to the compression element 3.

The compression element 3 is provided with a cylinder 4 internally having a cylinder chamber 41, a front head 5 and a rear head 6 provided oppositely to the cylinder 4 in open spaces above and below the cylinder 4, and a roller 7 arranged revolvably inside the cylinder chamber 41. Then, lower portions of the drive shaft 21 are supported by bearing portions provided in the heads 5 and 6. Further, the roller 7 is slidably mounted around an eccentric section 22 of the drive shaft 21. Therefore, when the drive shaft 21 rotates, the roller 7 revolves around the eccentric section 22 while being put in sliding contact with the eccentric section 22.

Further, a lubricating oil passage 23 is formed at the center of the drive shaft 21. This lubricating oil passage 23 is opened to a bottom section oil reservoir 1*b* of the casing 1. In addition, a pump element 24 is mounted at the entrance of the lubricating oil passage 23. Further, a middle exit of the lubricating oil passage 23 is opened to the sliding contact surface of the eccentric section 22 sliding and contacting to the sliding contact surface of the roller 7. Therefore, the lubricating oil pumped up from the oil reservoir 1*b* by the pump element 24 can be supplied from the lubricating oil passage 23 to the sliding contact surfaces. Further, in FIG. 2, the reference numeral 1*a* denotes an external discharge pipe connected to an upper portion of the casing 1.

Figure 1:
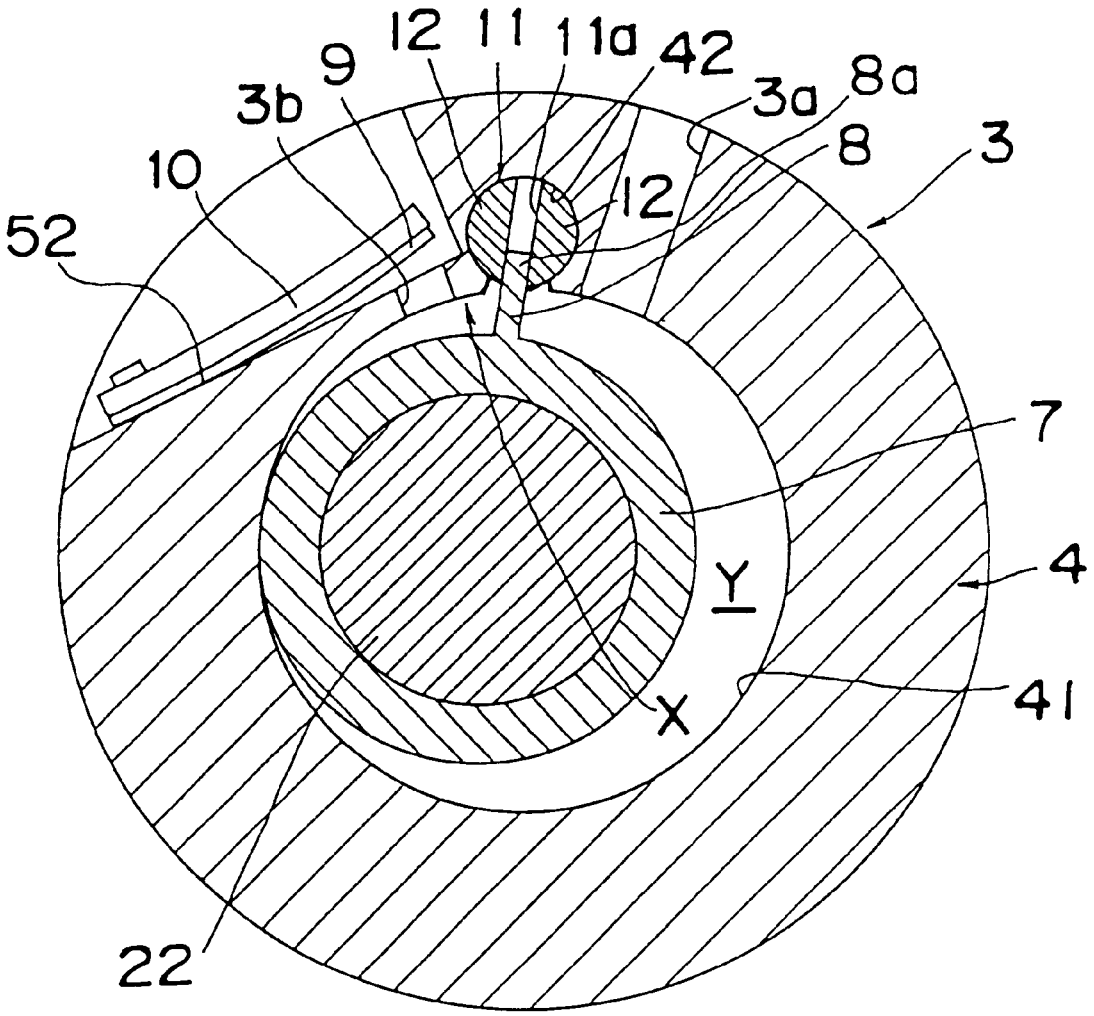
FIG. 1 is a plane cross section view showing an essential part of a cylinder provided in a rotary compressor according to a first embodiment of the present invention.

Further, as shown in FIG. 1, a suction port 3*a* opened to the cylinder chamber 41 is formed at a peripheral wall of the cylinder 4. Near the suction port 3*a*, there is formed a discharge port 3*b* opened to the cylinder chamber 41 at the peripheral wall of the cylinder 4. A gas fluid is inhaled from the suction port 3*a* into the cylinder chamber 41, while the gas fluid in the cylinder chamber 41 is discharged from the discharge port 3*b*.

Further, as shown in FIG. 1, a blade 8 protruding radially outwardly of the roller 7 is integrally formed with an outer peripheral portion of the roller 7. On the other hand, a cylindrical retainer hole 42 is formed between the suction port 3*a* and the discharge port 3*b* of the cylinder 4. Then, a support member 11 comprised of semicircular pillar-shaped members 12 and 12 each having a semicircular section shape are pivotally fitted in the retainer hole 42. The mutually opposite flat surfaces of the semicircular pillar-shaped members 12 constitute a reception groove 11*a*. This reception groove 11*a* has its one end communicated with the inside of the cylinder chamber 41, and an end portion 8*a* of the blade 8 is slidably inserted in the reception groove 11*a*. This blade 8 partitions the inside of the cylinder chamber 41 into a compression chamber X and a suction chamber Y. Further, a plate-shaped valve 9 for opening and closing the discharge port 3*b* is provided on a valve seat 52 formed around the exit of the discharge port 3*b* so that it contacts closely to the valve seat. A backing plate 10 is adhered to this valve 9. Then, the rotary compressor CP uses a substitute fleon refrigerant as a working fluid to be supplied to and discharged from the inside of the cylinder chamber 41. HFC group R134a or R407c is used as the substitute fleon refrigerant. Further, an oil in adaptation with the substitute fleon refrigerant is used as a lubricating oil. A synthetic oil such as ester oil, ether oil or the like is used as the oil adapted to the substitute fleon refrigerant.

In the rotary compressor CP constructed as above, when the drive shaft 21 is driven, the protruded end portion 8*a* of the blade 8 provided on the roller 7 comes in and out along the reception groove 11*a* of the support member 11, and the support member 11 pivots simultaneously. That is, the blade 8 always partitions the inside of the cylinder chamber 41 into the compression chamber X and the suction chamber Y by advancing and retreating in the radial direction while swinging with the revolution of the roller 7.

According to the rotary compressor CP, differently from the prior art, the end portion of the blade 8 is not put in contact with the outer peripheral surface of the roller 7 when the roller 7 is made to revolve without turning around the eccentric section 22, meaning that the blade 8 and the roller 7 do not relatively move. Therefore, according to this embodiment, there is generated no sliding friction between the blade 8 and the roller 7 to cause no boundary lubrication state. Therefore, a frictional loss and a power loss in the sliding portion inside the compressor can be reduced while incurring neither seizure nor oil deterioration, and by using the substitute fleon refrigerant as the working fluid and using the oil adapted to the substitute fleon refrigerant as the lubricating oil, conservation of the environment can be achieved.

It is to be noted that fluorine oil may be used instead of the synthetic oil, or alkylbenzene oil may be used in the above embodiment. Otherwise, mineral oil may be used. A mixture refrigerant obtained by mixing a plurality of substances in a group of substances classified into hydrofluorocarbon (HFC) may be used as the substitute fleon refrigerant.

In the above embodiment, the outer peripheral portion of the roller 7 is integrally formed with the blade 8. However, they may be integrated with each other by forming a mounting groove capable of allowing the insertion of a part of a base of the blade 8 in the roller 7, inserting the part of the base of the blade 8 into the mounting groove, and bonding them with an adhesive. Otherwise, the blade 8 may be integrated with the roller 7 by brazing instead of the adhesion with the adhesive. Otherwise, the base of the blade 8 may be fixed on the roller 7 by a pin or the like.

Furthermore, the support member 11 may be constituted by one cylindrical member formed with a cut groove which serves as a receiving groove for allowing the blade 8 to slide thereon.

(Second Embodiment)

Figure 3:
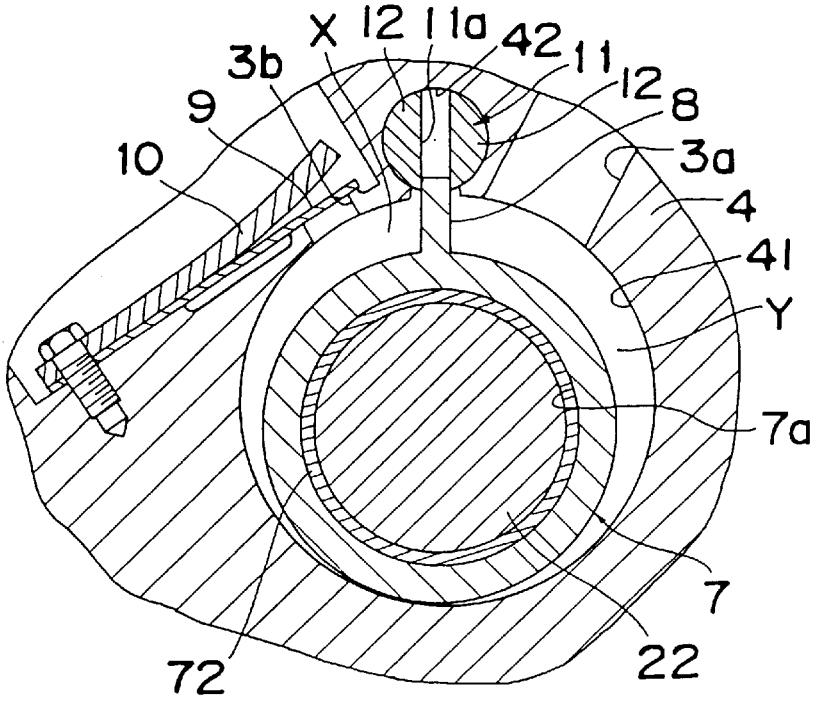
FIG. 3 is a plane cross section view showing an essential part of a cylinder for explaining a second embodiment of the present invention.

Furthermore, as shown in FIG. 3, a pipe-shaped metal 72 may be inserted in between the inner peripheral surface 7*a* of the roller 7 and the eccentric section 22 of the drive shaft 21. In this case, even when the lubricating capability is reduced due to the use of the substitute fleon refrigerant, the occurrence of seizure of the eccentric section 22 with the roller 7 can be prevented by virtue of the existence of the pipe-shaped metal 72.

(Third Embodiment)

Figure 4:
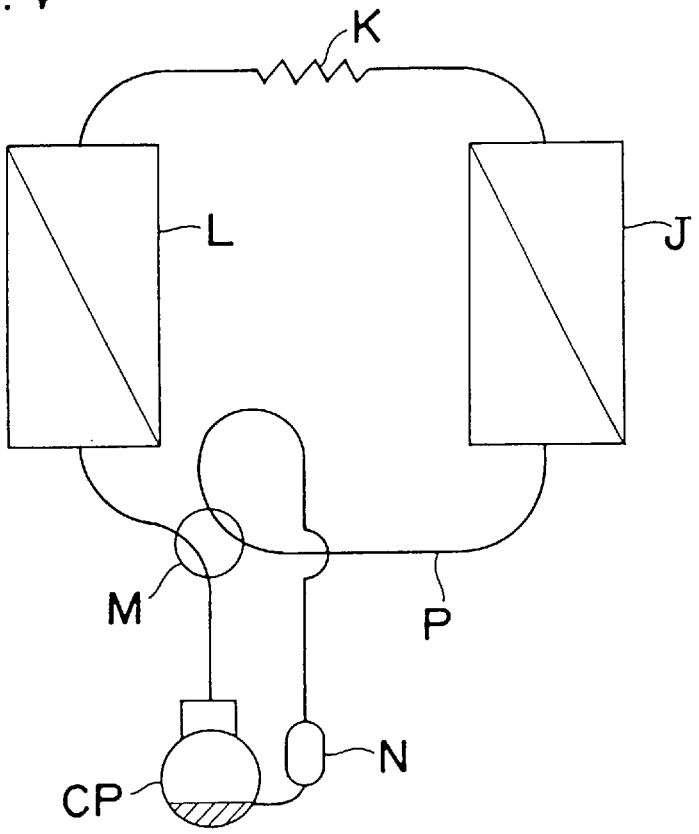
FIG. 4 is a refrigerating circuit representing a refrigerating apparatus according to a third embodiment of the present invention.

Next, FIG. 4 shows a heat pump type refrigerating apparatus in which the aforementioned rotary compressor CP of the first embodiment is incorporated.

This heat pump type refrigerating apparatus has a refrigerating circuit including a rotary compressor CP, a use side heat exchanger J, a capillary tube K and a heat source side heat exchanger L. The use side heat exchanger J operates as a condenser in the time of heating and operates as an evaporator in the time of cooling. The heat source side heat exchanger L operates as an evaporator in the time of heating, and operates as a condenser in the time of cooling. The capillary tube K operates as an expansion mechanism. Further, the reference character N denotes an accumulator provided on the suction port side of the rotary compressor CP. The refrigerating circuit has a four-way changeover valve M, and is provided with a pipe P arranged so that it can achieve a reversible cycle by a changeover operation of the four-way changeover valve M.

The rotary compressor CP is the rotary compressor CP of the first embodiment shown in FIG. 1. That is, the blade 8 which partitions the inside of the cylinder chamber 41 into the compression chamber X and the inhalation chamber Y is integrally provided radially outwardly of the roller 7 mounted around the eccentric section 22 of the drive shaft 21. Then, the tip end portion 8*a* of the blade 8 is inserted in the reception groove 11*a* of the support member 11 that is pivotally supported by the cylinder 4.

Further, a substitute fleon refrigerant similar to that of the first embodiment is used as the working fluid to be circulated through the refrigerating circuit. Furthermore, an oil adapted to the substitute fleon refrigerant similar to that of the first embodiment is used as the lubricating oil of the rotary compressor CP.

Figure 5:
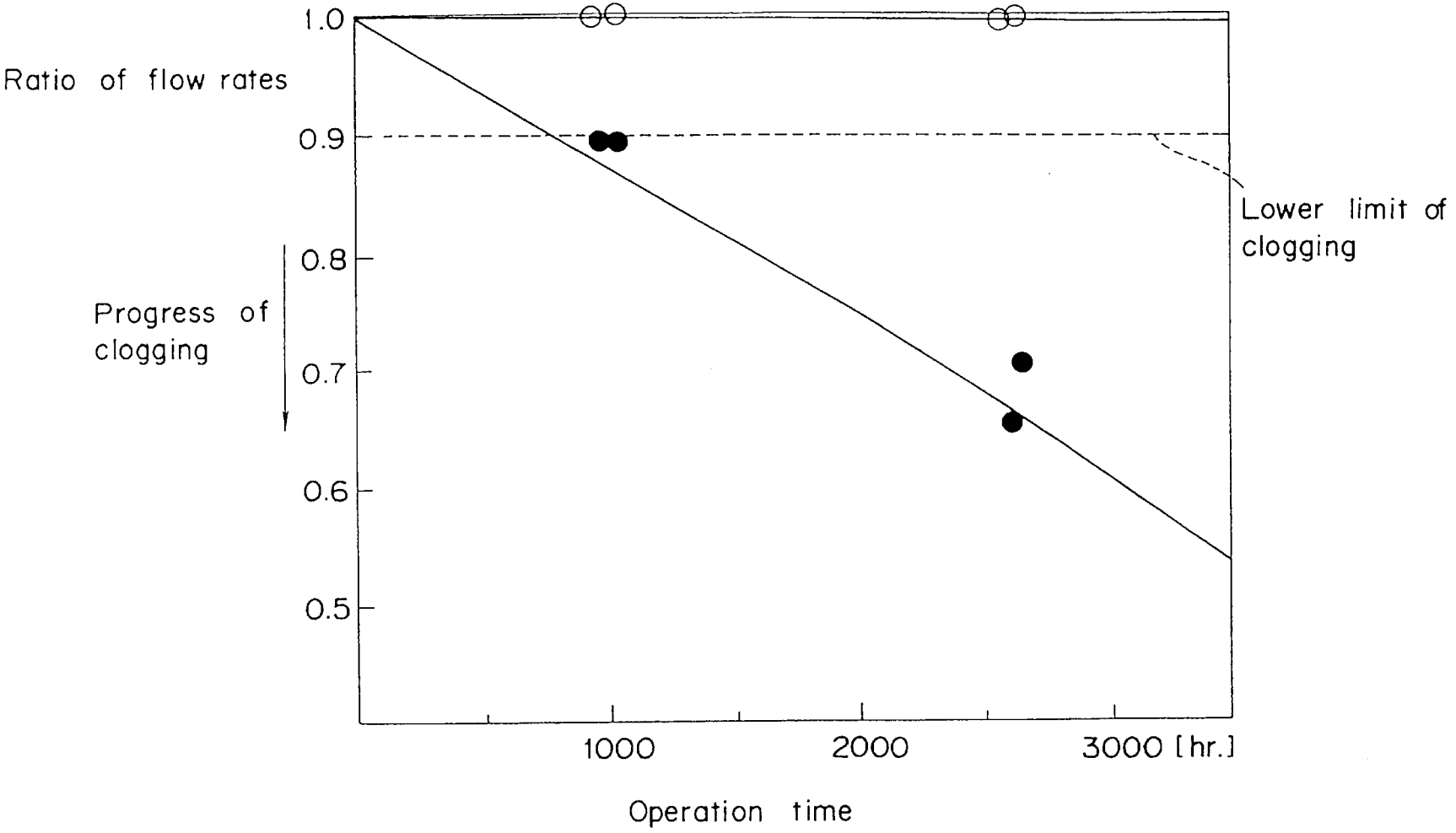
FIG. 5 is a graph of characteristics showing the variations in the ratio of flow rates of capillary tubes with respect to the elapse of an operation time.
Figure 6:
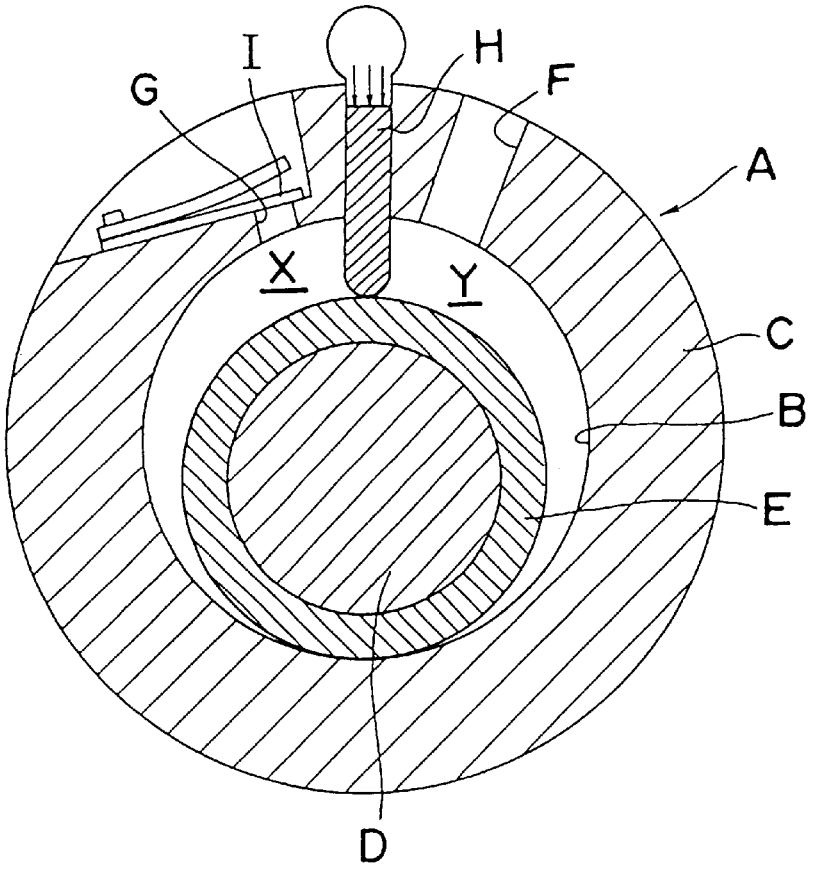
Fig. 6 PRIOR ART
FIG. 6 is a plane cross section view showing a compression element of a prior art rotary compressor.
Figure 7:
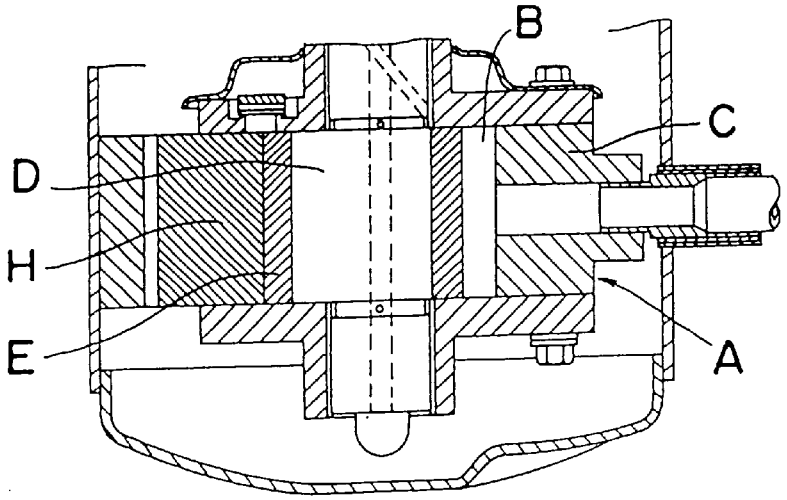
Fig. 7 PRIOR ART
FIG. 7 is a section view of a part of the above prior art rotary compressor.

FIG. 5 shows a comparison between the characteristic of a clogging state of the capillary tube K in the refrigerating apparatus of the third embodiment and the characteristic of a clogging state of a capillary tube in a refrigerating apparatus in which the prior art vane type rotary compressor shown in FIG. 6 is incorporated. FIG. 5 shows how the ratio of reduced flow rate to full flow rate of the refrigerant varies as the operation time elapses. The variation of the ratio of the flow rates occurs due to the clogging of the capillary tube. In FIG. 5, the white dots indicate the ratio of the flow rates in the case where the rotary compressor of the second embodiment is used, while the black dots indicate the ratio of the flow rates in the case where the prior art rotary compressor shown in FIG. 6 is used. In the above experiment of measuring the ratio of the flow rates, the operated room air conditioner had one horse power, HFC family R134a was used as the substitute fleon refrigerant, ester oil was used as the oil in conformity with the substitute fleon refrigerant, and the capillary tube diameter was 1 mm.

As is apparent from FIG. 5, when the prior art rotary compressor shown in FIG. 6 is used, the ratio of the flow rates of the capillary tube reduces by about 0.13 per 1000 hours of the operation time as indicated by the black dots. In contrast to this, when the rotary compressor of the embodiment of the present invention is used, the ratio of the flow rates reduces by not greater than 0.01 even after the elapse of the operation time of not less than 2500 hours as indicated by the white dots. That is, according to the embodiment of the present invention, the amount of reduction of the ratio of the flow rates can be remarkably reduced further than in the prior art, and this means that almost no clogging of the capillary tube is occurring.

As described above, according to the refrigerating apparatus of the third embodiment, the substitute fleon refrigerant for assuring the environmental safety can be used without incurring the oil deterioration in the rotary compressor CP. Furthermore, the possible adhesion of oil sludge to the inside of the capillary tube K can be prevented, and the reduction in flow rate of the refrigerant can be prevented, thereby allowing the reliability of the refrigerating apparatus to be improved. Therefore, according to the third embodiment, the conservation of the environment and the improvement of the reliability of the refrigerating apparatus can be concurrently satisfied.

As to the rotary compressor CP to be incorporated into the refrigerating apparatus, it is a matter of course that the aforementioned rotary compressor of the second embodiment may be incorporated. In this case, the frictional loss and the power loss can be further reduced.

INDUSTRIAL APPLICABILITY

As described above, the rotary compressor and the refrigerating apparatus of the present invention can be applied to a variety of air conditioners and refrigerators. In particular, when applied to any air conditioner or any refrigerator using a substitute fleon refrigerant for assuring the environmental safety, the present invention is very effective for the improvement of the reliability.

What is claimed is:

1. A rotary compressor comprising:

a roller rotatably mounted around an eccentric section of a drive shaft;

a blade which is integrally fixed on a periphery of the roller and extends radially outwardly of the roller, thereby partitioning a cylinder chamber inside a cylinder into a compression chamber and a suction chamber; and a support member which is pivotally supported by the cylinder and is formed with a reception groove for receiving a guiding therein a protruded end portion of the blade, wherein a refrigerant which does not include chlorine within its basic chemical composition is used as a working fluid to be supplied to and discharged from the inside of said cylinder chamber, and an oil adapted to the refrigerant is used as a lubricating oil.

2. A rotary compressor as claimed in claim 1, comprising:

a pipe-shaped metal inserted in between an inner peripheral surface of the roller and the eccentric section of the drive shaft.

3. A rotary compressor as claimed in claim 1, wherein said refrigerant is a single substance which belongs to a group of substances classified into hydrofluorocarbon (HFC).

4. A rotary compressor as claimed in claim 1, wherein said refrigerant is a mixture refrigerant obtained by mixing a plurality of substances which belong to a group of substances classified into hydrofluorocarbon (HFC).

5. A rotary compressor as claimed in claim 1, wherein said lubricating oil is any of a synthetic oil to which ester oil and ether oil belong, fluorine oil, alkylbenzene oil and mineral oil.

6. A refrigerating apparatus comprising:

a refrigerating circuit having a rotary compressor including a roller rotatably mounted around an eccentric section of a drive shaft, a blade which is integrally fixed on a periphery of the roller and extends radially outwardly of the roller, thereby partitioning a cylinder chamber inside a cylinder into a compression chamber and a suction chamber, and a support member which is pivotally supported by the cylinder and is formed with a reception groove for receiving and guiding therein a protruded end portion of the blade; and a capillary tube which serves as a pressure reduction mechanism, wherein a refrigerant which does not include chlorine within its basic chemical composition is used as a working fluid to be circulated through the refrigerating circuit, and an oil adapted to the refrigerant is used as a lubricating oil of the compressor.

7. A refrigerating apparatus as claimed in claim 6, wherein said refrigerant is a single substance which belongs to a group of substances classified into hydrofluorocarbon (HFC).

8. A refrigerating apparatus as claimed in claim 6, wherein said refrigerant is a mixture refrigerant obtained by mixing a plurality of substances which belong to a group of substances classified into hydrofluorocarbon (HFC).

9. A refrigerating apparatus as claimed in claim 6, wherein said lubricating oil is any of a synthetic oil to which ester oil and ether oil belong, fluorine oil, alkylbenzene oil and mineral oil.

* * * * *